United States Patent [19]

Banks

[11] Patent Number: 5,042,954

[45] Date of Patent: Aug. 27, 1991

[54] PORTABLE, PURSE OR POCKET SIZE GEMSTONE CLEANER

[76] Inventor: Robert E. Banks, 8906 Goldentree La., Baltimore, Md. 21221

[21] Appl. No.: 566,773

[22] Filed: Oct. 3, 1990

[51] Int. Cl.[5] ..... B43K 31/00

[52] U.S. Cl. ..... 401/198; 63/2; 401/202

[58] Field of Search ..... 401/198, 196, 199, 202, 401/205, 206, 262; 63/2

[56] References Cited

U.S. PATENT DOCUMENTS 2,726,416 12/1955 Lepkowski ..... 401/198 X
2,740,979 4/1956 Bridy ..... 401/198
2,975,464 3/1961 Schultz ..... 401/198
4,389,132 6/1983 Valadez ..... 401/202
4,818,134 4/1989 Tsai ..... 401/202

*Primary Examiner*—Richard J. Johnson

[57] ABSTRACT

This application relates to a means and method for cleaning diamonds and other gemstones to restore their shine. It is designed as a portable gemstone cleaning device to be carried by a person such that it would be usable at any time. The device comprises a container partially filled with a gem cleaning solution and having an applicator mounted in the container to apply the solution to a gemstone.

2 Claims, 1 Drawing Sheet

PORTABLE, PURSE OR POCKET SIZE GEMSTONE CLEANER

Figure 1:
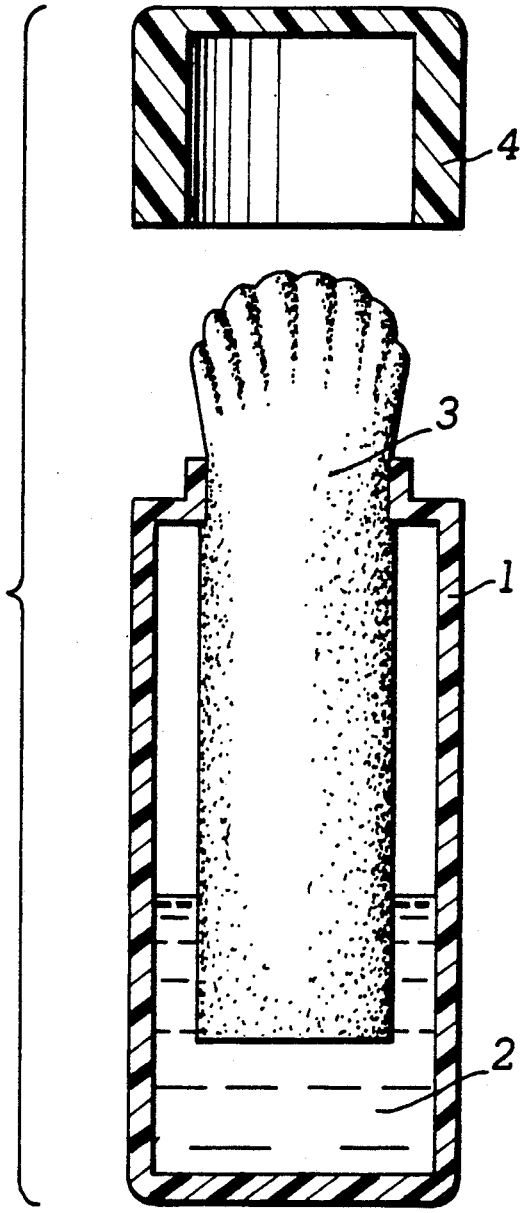

This invention relates to a means of applying cleaning solution to gemstones using a protable gemstone cleaner.

The present invention has for an object to provide an easy to carry means for convenient use as a portable gemstone cleaner. Gemstones, real or imitation, are usually mounted in rings, bracelets, pins, earrings, and necklaces. In the case of rings, cleaning the gemstones generally requires removing the ring from the finger and soaking the ring, and consequently the gemstone, in a cleaning solution. However, gemstones are difficult to keep clean; even the slightest amount of body oil from the hands, other parts of the body, or clothes diminishes the shine of these gemstones. To alleviate this problem, typically a person would carry this portable gemstone cleaner in their pocket or purse just like any other accessary. As an example, in the case of a diamond ring, to use the portable gemstone cleaner, a person would open the portable gemstone cleaner, dab a little of the cleaning solution on the diamond, rinse with water and wipe off with a towel. The gemstone would be shiny again even without the need to rmove the ring from the finger.

Referring to the drawing

FIG. 1 is a longitudinal sectional view through the portable gemstone cleaner illustrating the construction of the cleaner.

Referring to the drawing, FIG. 1, in detail,

The container means 1, shown approximate twice actual size, can be any container such as an vial, plastic casing, glass bottle, plastic bottle, metal casing.

The cleaning solution 2 is any chemical type cleaner such as a weak ammonia solution used to clean gemstones.

The applicator means 3 can be any type of material that is capable of conveying a cleaning solution 2 from the container 1 to the tip of the applicator means 3. This applicator means 3 transfers the cleaning solution 2 from the container 1 to the surface of a gemstone by rubbing contact with the gemstone.

The cover means 4 is a top or cap or closure used to prevent the loss of cleaning solution 2 from the container 1.

Having described my invention I claim:

1. A method of cleaning diamond or other gem stone jewelry by a user of the jewelry comprising, providing a portable gemstone cleaner of a size to fit in a purse or pocket, said cleaner comprising a container having a removable cover and being at least partially filled with a fluid suitable for cleaning gemstones and including fluid applicator means in communication with the fluid for rubbing contact with gemstone, removing the cover to expose the applicator means, using the applicator means to apply the cleaning fluid to the gemstone whereby to clean the surface thereof, and removing any remaining cleaning fluid residue from the gemstone.

2. A portable gemstone cleaner comprising: a container sized to be carried in a pocket or purse and being at least partially filled with a cleaning solution specifically intended for cleaning a gemstone such as a diamond, the container including an applicator means in communication with the cleaning solution, said applicator means being designed for rubbing contact with a gemstone, cover means for said applicator means to prevent the loss of cleaning solution from the container when it is not in use, whereby a user may carry the portable gemstone cleaner for use whenever desired to clean a gemstone.

* * * * *